United States Patent [19]

Finn

[11] 4,005,809

[45] Feb. 1, 1977

[54] DISPENSER CARTON

[76] Inventor: William W. Finn, 303 N. Kalamazoo Ave., Marshall, Mich. 49068

[22] Filed: Apr. 11, 1975

[21] Appl. No.: 567,399

Related U.S. Application Data

[63] Continuation-in-part of Ser. No. 441,880, Feb. 12, 1974, Pat. No. 3,942,417.

[52] U.S. Cl. ..... 225/49

[51] Int. Cl.[2] ..... B26F 3/02

[58] Field of Search ..... 225/39, 48–52, 225/91; 93/36 CE, 36 M, 49 M; 229/51 CE

[56] References Cited

UNITED STATES PATENTS

| | | | |
|---|---|---|---|
| 2,628,179 | 2/1953 | Bergstein | 225/48 X |
| 2,888,181 | 5/1959 | Lincoln et al. | 225/91 X |
| 3,193,427 | 7/1965 | Rogers | 225/49 X |
| 3,281,036 | 10/1966 | Woodling | 225/49 |

FOREIGN PATENTS OR APPLICATIONS

| | | | |
|---|---|---|---|
| 240,324 | 9/1962 | Australia | 225/50 |

*Primary Examiner*—Frank T. Yost

[57] ABSTRACT

A dispenser carton for use in dispensing sheet material from a roll contained within the carton comprises bottom, rear, front, and end panels joined to one another to form a hollow carton body open at its top. One edge of a top panel is hingedly joined to the upper edge of the rear panel so as to overlie the top of the carton and its opposite edge is joined to a flap which partially overlies the front panel. At the juncture between the front and bottom panels is a gap or series of gaps defining two spaced apart edges both of which carry an abrasive adhesive which forms tearing means for sheet material dispensed from the carton.

6 Claims, 7 Drawing Figures

DISPENSER CARTON

RELATED APPLICATIONS

This application is a continuation-in-part of application Ser. No. 441,880, filed Feb. 12, 1974, now U.S. Pat. No. 3,942,417.

The invention disclosed herein relates to the manufacture of a carton adapted to contain sheet material wound on a roll and from which any desired length of material may be unwound and severed or torn from the remainder of the material. The tearing of the sheet material is facilitated by a tear strip forming an integral part of the carton.

Cartons of the kind to which the invention relates are in wide usage, particularly for the dispensing of materials such as foil, waxed paper, various kinds of synthetic wrapping materials, and the like. All such cartons incorporate tearing means of one kind or another for the purpose of enabling a length of material withdrawn from the carton to be severed from the roll of material. The provision of an adequate tearing device has been particularly troublesome. Because cartons of the kind described conventionally are used in kitchens where water abounds, the tearing device must be resistant to deterioration due to water contact. Moreover, the carton itself must be capable of withstanding contact with water without undue weakening or other deterioration of the structural integrity of the carton.

From a structural point of view, the most reliable tearing device heretofore in use with dispensing cartons is a metal strip having a toothed or serrated edge against which the sheet material may bear so as to tear the material. A metal strip, however, has many disadvantages. For example, it must be manufactured separately from the carton itself and then staked, adhered, or otherwise affixed to the carton. These operations require machinery and manpower, thereby increasing the cost of manufacture and assembly of such cartons. In addition, metal tearing devices can mar counters, tables, appliances, and the like on which the cartons are used. Moreover, metal tearing devices having serrated or toothed edges can cause injury to the person using a carton equipped with such a tearing device.

Another disadvantage of metal tearing devices is that they are likely to rust unless they are formed of rust inhibiting metal or are treated with a rust inhibiting coating. Such metals and coatings add to the expense of the cartons.

A further disadvantage of metal tearing devices is that they prevent or interfere with recycling of the carton bodies unless the metal strips first are removed from the bodies. In either case, the metal strips must be handled in a manner differently from that in which the cartons themselves are handled or treated in recycling operations.

The disadvantages of metal tearing devices as described above are well known, and many proposals have been made for effecting substitution of some other kind of tearing device for the metal strips. Most, if not all, of these proposals have required modification of the carton itself, with the consequent modification or redesign of the carton manufacturing and erecting machinery presently in use. Such machinery represents a substantial capital investment on the part of carton manufacturers who understandably have been reluctant to incur the expense of such modification or redesign, particularly in view of the highly competitive nature of the carton manufacturing industry.

An object of this invention is to provide a dispensing carton having a self-contained tearing device and which overcomes or greatly minimizes the disadvantages referred to above.

Another object of the invention is to provide a tearing device for a dispensing carton and which reinforces the carton and can be applied to the carton during the manufacture of the latter.

A further object of the invention is to provide a carton having an integral tearing device and which may be manufactured and erected by machinery presently in use.

Another object of the invention is to provide a dispensing carton and tearing device combination which is less expensive to manufacture than cartons currently manufactured for similar purposes and which is recyclable.

A further object of the invention is to provide a method of manufacturing a carton of the character described.

Other objects and advantages of the invention will be pointed out specifically or will become apparent from the following description when it is considered in conjunction with the appended claims and the accompanying drawings, in which:

Figure 1:
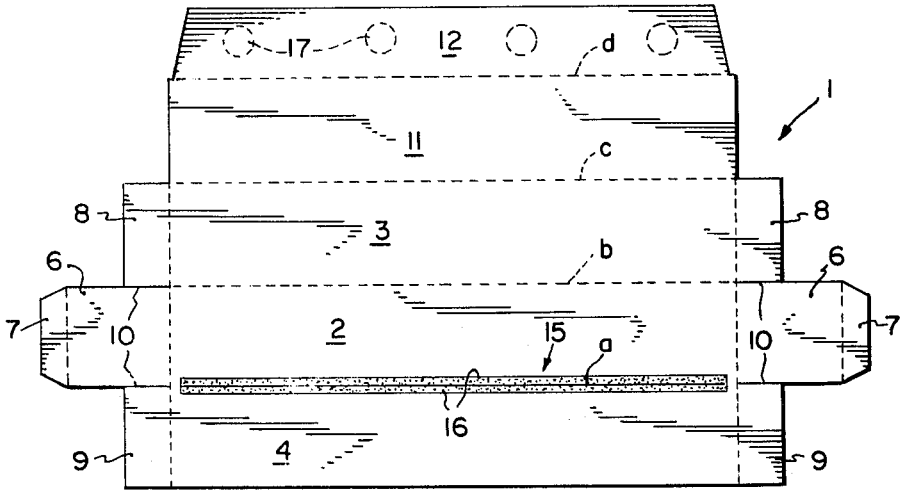
FIG. 1 is a plan view of a blank from which a carton according to one embodiment of the invention may be manufactured.
Figure 2:
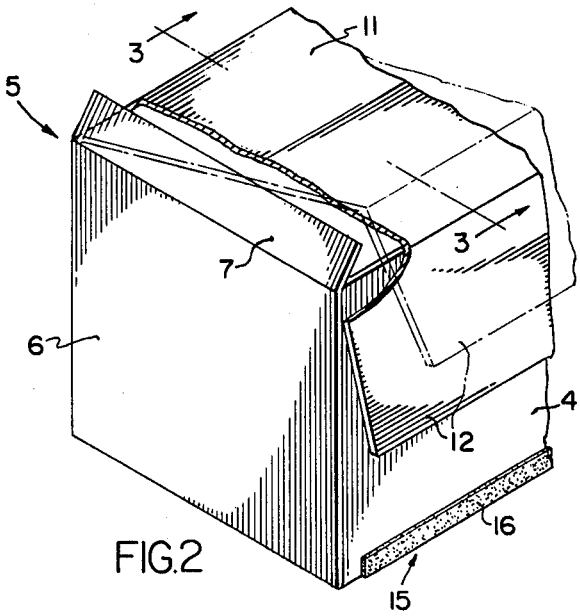
FIG. 2 is a fragmentary, isometric view on an enlarged scale of a carton formed from the blank shown in FIG. 1.
Figure 3:
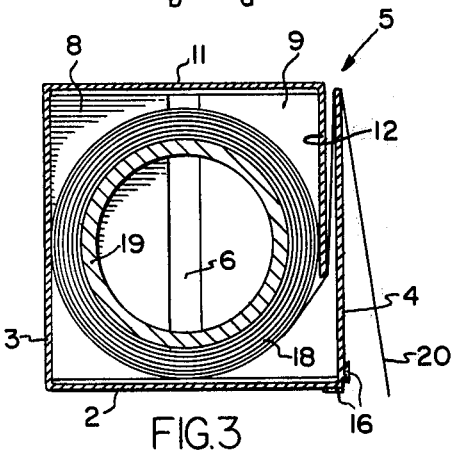
FIG. 3 is a sectional view taken on the line 3—3 of FIG. 2, but illustrating the carton in condition for the dispensing of sheet material wound on a roll.
Figure 4:
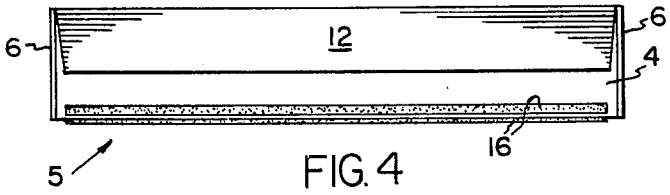
FIG. 4 is a front elevational view, on a reduced scale, illustrating the carton shown in FIG. 2.

A carton constructed in accordance with the invention shown in FIGS. 1 – 5 is manufactured from a blank 1 of a suitable material such as 16 or 18 point solid kraft paperboard which is die cut and which is scored along the lines *a*, *b*, and *c* shown in FIG. 1 to provide a plurality of panels 2, 3, and 4 which may be bent or folded to form an open top carton 5 in which the panel 2 forms the bottom wall, the panel 3 forms the rear wall, and the panel 4 forms the front wall. The panel 2 has extensions 6 which form end walls for the carton 5 and each extension terminates in a tab 7 which may be bent to project inwardly of the carton as is best shown in FIG. 2. The panels 3 and 4 have tabs 8 and 9, respectively, severed from the extensions 6 by slits 10, so as to enable them to be folded inwardly of the carton and glued to the inner surfaces of the adjacent extensions 6 to reinforce the end walls of the carton.

Joined to the panel 3 is one edge of a similar panel 11 which forms the top wall of the carton. Joined to the opposite edge of the panel 11 is one edge of a panel or flap 12 which is adapted to overlie the front wall 4 of the carton in the manner shown in FIG. 2. Between the panels 11 and 12 is a score line *d*.

The length and width of the panels 2, 3, 4, and 11 are substantially uniform so that the carton formed thereby is substantially square in cross-section. The length of the flap 12 corresponds substantially to the length of the other panels and its opposite ends taper toward its free edge. The width of the flap 12 is substantially one-half the width of the panel 4.

The score line *a* between the panels 2 and 4 is a cut score. That is, the skin of the stock from which the blank 1 is made is ruptured, but the depth of the rupture is less than the thickness of the stock. When the blank 1 is in its flat condition, as shown in FIG. 1, the opposing edges 13 and 14 of the cut score abut one another. The rupture of the skin of the stock may be continuous from end to end of the score line *a* or, alternatively, the rupture may be interrupted so as to provide alternating cut and uncut zones longitudinally of the score line. Preferably, the opposite ends of the score line are cut.

An abrasive adhesive 15 is applied to the adjacent edges of the panels 2 and 4 in such manner that it forms a strip 16 which overlies the score line *a*. The adhesive is applied by a conventional striping, printing, or other conventional process. The abrasive adhesive preferably comprises a waterproof, volatile, quickly drying printing ink or commercially available adhesive in which is suspended a large quantity of silicate or other grit. The printing ink or adhesive preferably is one which is capable of impregnating the edges of the cut score *a* so as to swell and reinforce the edges. The printing ink or adhesive, upon drying, bonds the grit to the cutting teeth to provide a myriad of sharp, abrasive particles extending the length of the strip 16.

The flap 12 has its inner surface provided with a plurality of beads of separable adhesive 17 adjacent the free edge of the flap so as to enable the free edge of the flap to be bonded lightly to the front wall 4 of the carton and in overlapping relation therewith.

To erect the carton, the panels 2, 3, 4, 11, and 12 are bent about the score lines *a* – *d*, and the flaps 6 folded to form end walls. Prior to folding and securing of the end flaps 6, a roll of sheet material 18 wound on a core 19 is placed within the carton. Afterward, the flaps 6 and the tabs 8 are secured to form the finished carton.

Figure 5:
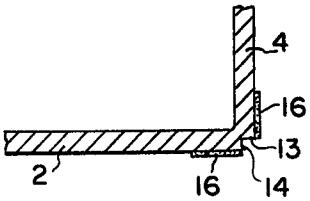
FIG. 5 is a greatly enlarged view of a portion of FIG. 3.

When the panels 2 and 4 are bent about the score line *a*, the edges 13 and 14 of the cut score *a* are spread apart by about 90° as is shown in FIG. 5. These edges are sharp and are reinforced by the adhesive. In addition, each edge has a myriad of sharp, abrasive particles extending substantially the length thereof, thereby providing a tear strip for the sheet material 18. The sharpness of the edges 13 and 14 is related to the thickness of the adhesive and to the extent of impregnation of the edges by the adhesive. Accordingly, the thickness of the adhesive strip should be only that necessary to assure firm retention of the grit particles. The thickness of the adhesive thus will depend in part on the size of the particles and may be determined empirically.

To dispense sheet material from the carton, the flap 12 is separated from the front wall 4 and is swung upwardly, together with the top panel 11, about the juncture of the top panel with the rear wall 3, as is indicated in chain lines in FIG. 2, so as to enable the leading end 20 of the sheet material 18 to be withdrawn from the interior of the carton. Thereafter, the flap 12 may be fitted into the carton with the leading end of the sheet material interposed between the flap and the inner surface of the front wall 4.

To sever a length of the sheet material, the leading end 20 is withdrawn from the carton and is caused to bear against the abrasively coated cutting edges 13 and 14. The sharpness of the cutting edges, coupled with the abrasiveness of the gritty particles, facilitates the tearing of the sheet so as to enable a desired length of material to be severed from the roll.

The impregnation of the adjacent edges of the carton walls 2 and 4 reinforces the latter at the zone of greatest stress, such stress being generated by the tearing of the sheet. The reinforcement of the adjacent portions of the walls 2 and 4 of the carton, coupled with the water-proof character of the abrasive adhesive 15, enhances the ability of the carton to withstand deterioration due to contact with moisture.

Figure 6:
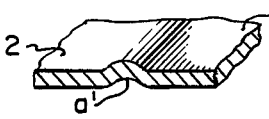
FIG. 6 is a fragmentary, isometric view of a carton blank illustrating a modification.
Figure 7:
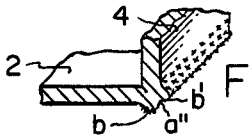
FIG. 7 is a view similar to FIG. 6, but illustrating the blank in a folded condition.

The embodiment shown in FIGS. 6 and 7 is the same as that previously described with the exception that the score line *a'* between the panels 2 and 4 is an inverted or debossed score over the concave side of which is printed or otherwise deposited the abrasive strip 16. When the panels 2 and 4 are bent to form the bottom and front walls, respectively, of the carton, the outer skin of the stock will split or rupture longitudinally of the score line *a'* to form either a continuous gap *a''* or a series of randomly spaced gaps between the panels 2 and 4, thereby resulting in a construction similar to that of the earlier described embodiment, but without necessitating the separate slitting operation. In addition, the bending of the panels 2 and 4 as described causes those portions of the panels adjacent them to bulge outwardly, as indicated at *b*, *b'*, thereby providing a well-defined cutting zone at the juncture of the panels 2 and 4.

The disclosed embodiments are representative of presently preferred forms of the invention, but are intended to be illustrative rather than definitive thereof. The invention is defined in the claims.

I claim:

1. A dispensing carton adapted for the dispensing of a length of material from a roll thereof, said carton being formed of sheet material and having a bottom wall, a pair of substantially parallel, upstanding, spaced apart front and rear walls joined to said bottom wall, and a pair of end walls, said sheet material having its outer skin ruptured at the juncture of said bottom wall with said front wall to a depth less than the thickness of said sheet material to provide at said juncture a gap, and an abrasive material carried by each of said front and bottom walls and bordering said gap to provide a pair of tearing edges on opposite sides of said gap.

2. A carton according to claim 1 wherein each of said tearing edges is impregnated with said abrasive material.

3. A carton according to claim 1 wherein said abrasive material extends substantially the full length of said tearing edges.

4. A carton according to claim 1 wherein said gap has a length corresponding substantially to the length of said abrasive material.

5. A carton according to claim 1 wherein the skin of said material is ruptured at spaced apart intervals.

6. A carton according to claim 1 wherein said bottom wall and said said front wall are bulged outwardly on opposite sides of and adjacent said gap.

* * * * *